US010301133B2

(12) United States Patent
Finnemore et al.

(10) Patent No.: US 10,301,133 B2
(45) Date of Patent: May 28, 2019

(54) CONTACT ROLL

(71) Applicant: Windmöller & Hölscher KG, Lengerich (DE)

(72) Inventors: David Finnemore, Derby (GB); Alexander Wulfert, Wersen (DE); Frank Hoffmann, Greven (DE)

(73) Assignee: Windmöller & Hölscher KG, Lengerich (DE)

( * ) Notice: Subject to any disclaimer, the term of this patent is extended or adjusted under 35 U.S.C. 154(b) by 118 days.

(21) Appl. No.: 15/527,974

(22) PCT Filed: Nov. 16, 2015

(86) PCT No.: PCT/EP2015/076700
§ 371 (c)(1),
(2) Date: May 18, 2017

(87) PCT Pub. No.: WO2016/079059
PCT Pub. Date: May 26, 2016

(65) Prior Publication Data

US 2017/0327334 A1 Nov. 16, 2017

(30) Foreign Application Priority Data

Nov. 20, 2014 (DE) ..... 10 2014 223 758

(51) Int. Cl.
*B65H 18/08* (2006.01)
*B65H 18/26* (2006.01)
(Continued)

(52) U.S. Cl.
CPC ..... *B65H 18/08* (2013.01); *B65H 18/20* (2013.01); *B65H 18/26* (2013.01); *B65H 27/00* (2013.01);
(Continued)

(58) Field of Classification Search
CPC ..... B65H 18/08; B65H 18/20; B65H 18/26; B65H 27/00
See application file for complete search history.

(56) References Cited

U.S. PATENT DOCUMENTS 3,796,361 A 3/1974 Rueckert
3,796,423 A 3/1974 Shuster
(Continued)

FOREIGN PATENT DOCUMENTS

EP 0994059 A1 4/2000
JP S5617846 A 2/1981
WO WO2012140912 A1 10/2012

OTHER PUBLICATIONS

PCT Notification of Transmittal of Translation of the International Preliminary Report of Patentability dated Sep. 8, 2017, issued for PCT Application No. PCT/EP2015/076700, as well as the English translation document, 9 pages.

*Primary Examiner* — Sang K Kim
(74) *Attorney, Agent, or Firm* — Bret E. Field; Bozicevic, Field & Francis LLP

(57) ABSTRACT

The invention describes contact rolls for pressing at least one web of material, preferably a web of plastic film, against at least one rotating winding device, the contact roll comprising a surface layer.
At least two segments are provided which are spaced axially apart and which extend around, in which segments the quality of the surface layer differs from the quality of the other areas of the surface layer, at least some portions of said segments being in contact with the edges of the at least one web of material.

12 Claims, 4 Drawing Sheets

(51) Int. Cl.
*B65H 18/20* (2006.01)
*B65H 27/00* (2006.01)

(52) U.S. Cl.
CPC .. *B65H 2401/112* (2013.01); *B65H 2404/132* (2013.01); *B65H 2404/5322* (2013.01); *B65H 2511/135* (2013.01)

(56) References Cited

U.S. PATENT DOCUMENTS

| | | | | | |
|---|---|---|---|---|---|
| 4,319,827 | A | | 3/1982 | Carter et al. | |
| 5,071,083 | A | * | 12/1991 | Tubota | B65H 18/16 226/193 |
| 5,553,806 | A | * | 9/1996 | Lucas | B65H 18/16 242/542.4 |
| 5,803,398 | A | * | 9/1998 | May | B65H 18/26 242/541 |
| 5,893,821 | A | | 4/1999 | Ando et al. | |
| 5,934,603 | A | | 8/1999 | Cole et al. | |
| 6,454,204 | B1 | * | 9/2002 | Reuter | B65H 75/243 242/597.5 |
| 2004/0056139 | A1 | * | 3/2004 | Shigemura | B65H 18/26 242/547 |
| 2004/0075011 | A1 | * | 4/2004 | Michel | B65H 18/106 242/530.1 |
| 2011/0014025 | A1 | | 1/2011 | Claris | |

* cited by examiner

CONTACT ROLL

The invention relates to a contact roll according to the preamble of claim 1, a winding device according to the preamble of claim 11, and a method according to the preamble of claim 12.

A contact roll is generally intended to press a web of material which is being wound onto a winding roll against said roll with a defined force, so that after completion of the winding the winding roll has a defined winding hardness. The winding hardness is determined by, inter alia, the amount of air included between the individual layers. The amount of such air can be influenced by means of the contact roll. For this purpose, known contact rolls have a surface layer which often extends over the entire contact roll, in the axial direction and the circumferential direction. These surface layers also have a certain thickness, reckoned in the radial direction. Often, the surface layer will be comprised of an elastically deformable material.

However, such contact rolls have been found to be disadvantageous in that the resulting winding has differing diameters at different axial positions of the winding. As the winding diameter is further increased, mechanical stresses are suffered by the web of material at such locations, which can lead to different properties of the web of material at these locations. If the web of material is a web of plastic material, for example, the web is stretched at such locations, which may lead to inferior pressability. Such locations are particularly pronounced at lateral edges and edge regions of the web of material. Here often a so-called edge buildup is observed, with the web of material having inhomogeneities in its edge regions in comparison to its inner and/or middle regions.

Accordingly, the object of the present invention is to avoid such an edge buildup, and to form wound rolls of products wherein the winding diameter is as constant as possible over its axial extent.

This object is achieved according to the invention by the group of features set forth in claim 1. Possible refinements of the invention are set forth in the dependent claims.

The inventive contact roll is distinguished in that at least two segments are provided which are separated from each other in the axial direction and which extend around in the circumferential direction, in which segments the characteristics of the surface layer differ from the characteristics in the other regions of the surface layer, wherein said segments are in contact with the edges of the at least one web of material.

The term "edges" means the two mutually parallel lateral edges of a web of material, along with a region extend from each of said edges toward the center of the film, for a distance of up to 2 cm, particularly up to 1 cm. At least in the area of the winding process of plastic films, the edges are formed by trimmed edges.

According to the invention, it is provided that the surface layer is not homogeneously constructed, but comprises segments in which the characteristics of the surface layer differ from the characteristics of the surface layer outside these segments. In this connection, it is advantageous if the surface layer outside the segments is homogeneously constructed. In the region of the segments, the characteristics are different.

It is further provided according to the invention that the edges of the web of material are contactable by the described segments, which edges are pressed against the winding roll with a higher pressing force that the other regions of the web. This results in an appreciable more homogeneous wound roll of the product, and avoidance of damage to the web of material, as demonstrated by tests which have been conducted.

The contact roll may comprise more than two of the described segments, for use of a contact roll to produce a plurality of windings simultaneously. According to the terminology in the area of winding technology, a plurality of individual strips is wound. The individual strips are produced by dividing the web of material as it is advanced, into a plurality of narrow webs of material which are then advanced in parallel, and are wound onto a plurality of winding rolls, which winding rolls as a rule are disposed in flush alignment on a single winding shaft. In such an arrangement, it is advantageous if one of the described segments is in contact with two neighboring edges of different webs of material.

According to a first advantageous embodiment of the invention, it is provided that the segments of the surface layer have a greater material hardness than the other regions of the surface layer, at least over part of the extent of said segments. The term material hardness is understood here to refer to the inherent hardness of the material. The segments may be at least in part fabricated from a different material than the other regions, or may be treated by different means during fabrication or afterwards. In particular in the case of an elastic material, it is advantageous if the segments are comprised of a material with a greater modulus of elasticity than the material of the other regions. Alternatively, or in addition, the surface layer may be subjected to pre-stressing in the region of the segments, regardless of whether the material chosen for the segments is different; e.g., the pre-stressing may consist of pressing the material from the interior outward in the region of the segments. With this solution, the material should be pressed to the extent that it departs from the linear range of the modulus of elasticity when the contact roll is pressed against the winding roll.

When a contact roll configured as described above is applied to the winding roll, the elastic surface layer of the contact roll is pressed against the contact surface according to the action-reaction principle. In the region of the segments, the restoration force of the material is greater than in the other regions, resulting in greater pressure force being applied to the edges of the web of material.

According to another advantageous embodiment, which can also be advantageous in connection with the above-described first embodiment, it is provided that the segments have a greater outer surface diameter than the respective regions of the surface layer which neighbor the segments. This does not necessarily require that the other regions of the surface layer of the contact roll always uniformly have the same outer diameter.

According to yet another advantageous embodiment of the invention, it is provided that the surface layer has various roughnesses on its outer surface, wherewith the segments have a different roughness than the other regions. It is particularly advantageous if the segments have a lower roughness than the other regions. Thus the outer surface of the segments is smoother, which results in formation of air cushions in these regions which cushions are thicker and/or more forceful than those in the other regions. This results in the edge regions of the web of material being pressed against the winding roll with greater pressure force than the other regions of the web material.

According to still another advantageous embodiment of the invention, it is provided that the surface layer has a bulging shape. The term bulging is understood to mean that the surface layer, and thus the entire contact roll, has a smaller outer diameter at its outer edges than in the other regions. As a result it appears, in a lateral view, that the contact roll has a concave form.

According to a recommended refinement of the invention it is provided that the contact roll is comprised of a base body and at least one sleeve concentrically surrounding this base body, which sleeve has one or more layers. The outer of which layers comprises the surface layer. The substantial advantage of this structure of the contact roll is that the sleeve is readily replaceable. This allows the contact roll to be readily adjusted to a given web of material which is to be wound onto a winding roll without having to provide a contact roll dedicated to that given web. E.g., given a particular number of individual strips, one may provide a special sleeve with the corresponding number of segments. Depending on the type of web of material, one may provide sleeves wherein, e.g., the edges press with different forces.

It is advantageous if the base body is comprised of at least one fiber-reinforced plastic. The fibers may be glass fibers and/or carbon fibers.

It is particularly advantageous if the sleeve which concentrically surrounds the base body is displaceable relative to the base body. This enables particularly easy exchangeability of the sleeves. In replacing the sleeve, the base body may be held at one end and the sleeve may be removed over the other, free end, by pulling or pushing it. The base body may be provided with removable bearings, so that during the winding process the contact roll will be supported by bearing means on both ends, thus in a stable configuration.

It is further advantageous if the base body and the sleeve are interconnectable by force-interlocking means. In particular it is provided that the force-interlocking means are operational at least between parts of the outer surface of the base body and parts of the inner surface of the sleeve. There are various possibilities for realizing this. The inner surface of the sleeve may be comprised of an elastic material, which is expanded by means of pressurized air delivered through air exit openings in the base body, which are preferably radially directed. This increases the inner diameter of the sleeve, facilitating easy pulling and pushing of the sleeve.

According to an alternative or supplemental embodiment, the base body may be provided with expansive force elements which can undergo variation of their outer diameter, e.g. by means of hollow spaces under the outer surface which can be acted upon by a fluid, such as a hydraulic fluid, which may be subjected to pressure. This results in an increased diameter of the outer surface, at least in some regions, whereby force is applied to the sleeve which holds the sleeve in place.

Another aspect of the object of the invention is a winding device for winding a web of material, preferably a web of plastic film material, onto a corresponding rotatable winding roll. This winding device is distinguished in that it is comprised of a contact roll as described above.

A further aspect of the object of the invention is a method of winding a web of material wherein at least one web of material is pressed against a rotating winding roll by means of a contact roll having a surface layer. According to the invention, it is provided that at least two segments which are separated from each other in the axial direction and which extend around in the circumferential direction, in which segments the characteristics of the surface layer differ from the characteristics in the other regions of the surface layer, are in contact with or are brought into contact with the edges of the at least one web of material.

Additional advantages, features, and characteristics of the invention will be apparent from the following description, in which a number of exemplary embodiments are described in particular, with reference to the accompanying drawings. It should be noted that the features described in the Specification and in the claims may individually be essential to the invention, or may be essential in various combinations which may be conceived of. In the context of the overall disclosure, it should be obvious that features and characteristics described in connection with the inventive method are part of the invention in combination with the inventive contact roll, and vice versa, so that as to the disclosure, for the individual aspects of the invention these features and characteristics are referred to interchangeably.

Figure 1:
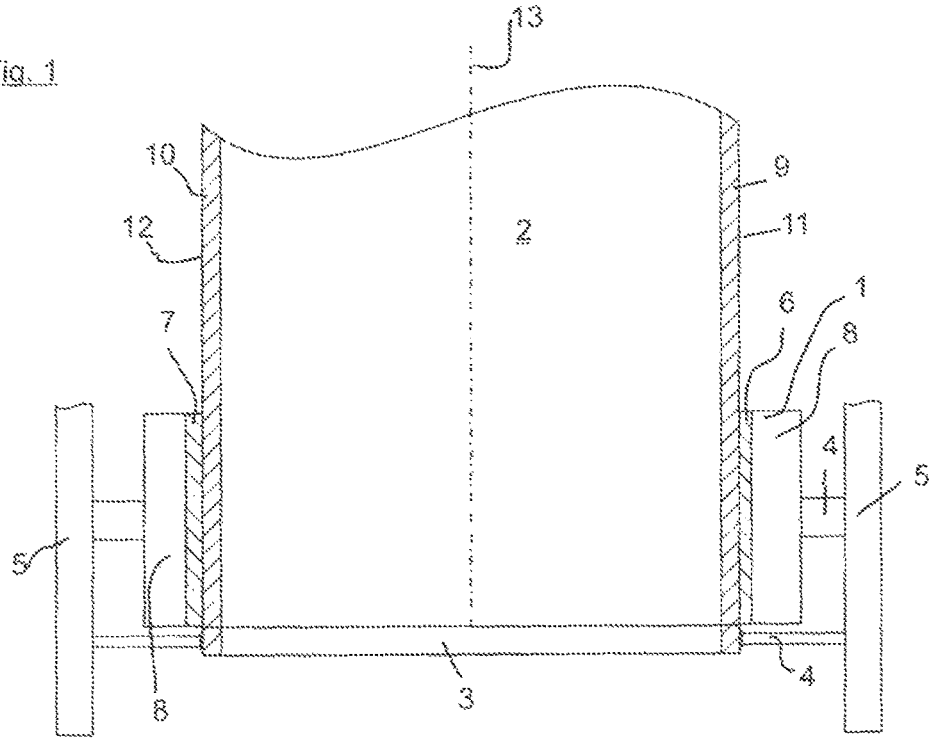
FIG. 1 illustrates a contact roll which is pressing a web of material against a winding device.

FIG. 1 illustrates an inventive contact roll 1 which presses a web of material 2 which is passing over it, which web is preferably a web of plastic film, against a winding device 3. The contact roll 1 and the winding device 3 are rotatably mounted, via pins and/or shafts 4, so as to be rotatable with respect to the machine frame 5. The pins and/or shafts 4 of the winding device 3 may also be displaceable with respect to the machine frame, so that when the winding diameter increases these pins and/or shafts constantly move farther from the contact roll 1.

The contact roll 1 has two segments 6, 7, which are shown with hatching for the sake of clarity. Partial areas of these segments 6, 7 are in contact with edge regions 9, 10 of the web of material 2.

The edge region of the web of material may be deemed to be the region up to 2 cm, preferably up to 1 cm, from the edges 11, 12 toward the middle 13 of the web.

The segments 6, 7 are parts of the surface layer of the contact roll, and have different characteristics than those of the other regions 8 of the surface layer, as will be described in more detail hereinbelow with reference to the additional Figures.

Figure 2:
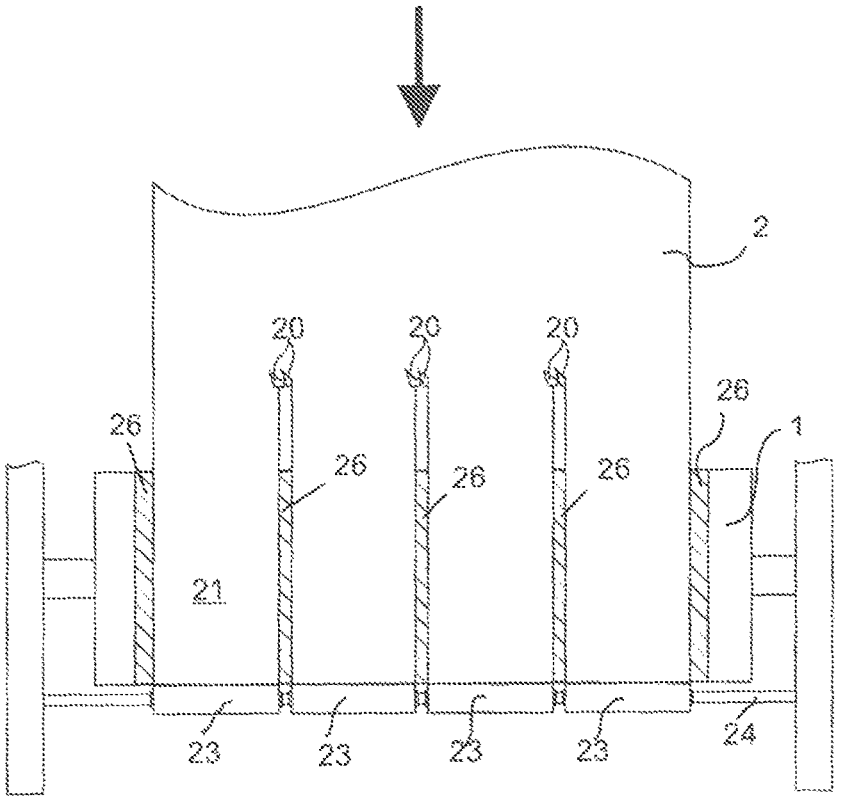
FIG. 2 illustrates a contact roll which is pressing a web of material separated into a plurality of individual strips against a winding device.

FIG. 2 illustrates an exemplary embodiment which is different from the exemplary embodiment according to FIG. 1, wherein cutting knives 20 are disposed upstream of the contact roll 1, which remove respective intermediate strips so as to divide the web of material into a plurality of separate webs of material 21, the so-called individual strips. This operation results in gaps between the individual strips, whereby said strips do not contact each other and therefore do not damage each other. The number of cutting knives which may be employed in the path of the web is variable, and thus the number of individual strips of material 21 is variable.

These individual strips of material 21 are each wound onto a respective winding device 23, with the winding devices 23 being placed under stress on a common winding shaft 24. The shaft 24 has the same characteristics as the pins and/or shafts 4 described in connection with FIG. 1.

The individual webs of material 21 are pressed against the corresponding winding devices 23 by the contact roll 1, and the contact roll for each edge region of an individual strip 21 has a segment 26, which segment may be in contact with neighboring edge regions of two directly neighboring individual strips.

The segments are provided with suitable means for pressing the edge regions of the web of material against the winding device with a greater force than the other regions of the contact roll.

Figure 3:
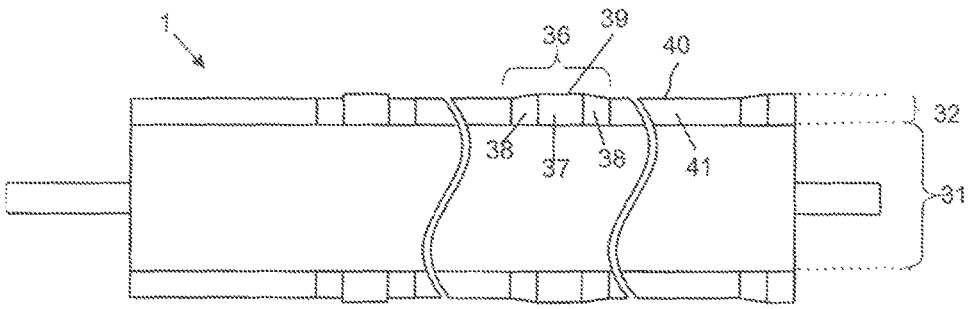
FIG. 3 illustrates a cross section through an inventive contact roll having elevated segments.

FIG. 3 illustrates a cross section through the inventive contact roll 1. The contact roll 1 shown has a roll core 31 and a surface layer 32, which layer 32 in the example shown covers the entire axial extent of the roll core. The segments 36 are formed in the surface layer, which layer may comprise various layers of materials which may different or may be the same or of the same type. Each segment 36 is comprised of a central segment 37, and border segments 38 disposed to the right and left of the central segment. The external surface 39 has a greater outer diameter than the outer surface 40 of the other regions 41. The border segments 38 provide a transition between the two said outer diameters, so that there is no abrupt change in the radial force exerted by the contact roll on the web of material with progression in the axial direction, but rather the force exhibits a transition.

The surface layer 32 is comprised of a plurality of parts, with the other regions 41 not being contiguous but being interrupted by the segments 36, which segments are preferably configured as ring structures. A central segment 37 and the border segments associated with it may be of unit construction but also may be of a multi-part construction. The external surfaces of the border segments, which extend at an angle to the axis of the contact roll, may be fabricated, e.g. by a fabrication method comprising forming. E.g. if the material of the segments is a plastic or a rubber, the forming method may comprise casting or the like. Further, after a segment is formed it may be subjected to additional, mechanical forming operations. The segments 36 may also be in the form of expansive force elements, as described in connection with FIG. 6. The advantage here is that the outer diameter can be adjusted.

Figure 4:
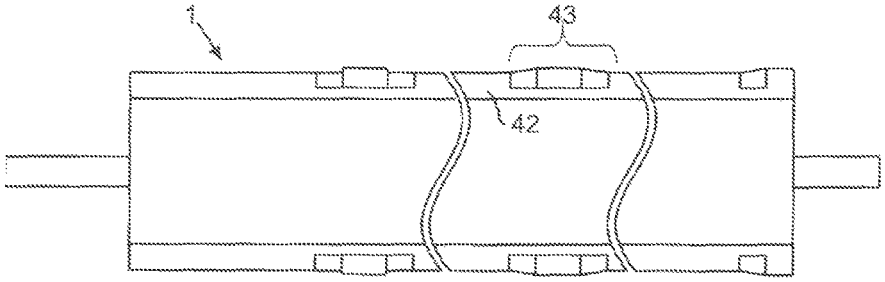
FIG. 4 illustrates a cross section through a second inventive contact roll having elevated segments.

FIG. 4 illustrates an alternative embodiment, in which, compared to FIG. 3, the surface layer 41 is no longer a multi-part layer. Rather, a pervasive surface layer 42 is provided. Here the segments 43 are simply applied over the surface layer 42. As illustrated in more detail in FIG. 4, the segments may also be disposed in circumferential grooves formed in the surface layer 42. These grooves may be produced by a cutting process, e.g. milling. In particular if the segments 43 are not disposed in grooves they may be displaceable relative to the surface layer in the axial direction of the contact roll. This greatly facilitates adjusting the inventive contact roll to the width of the web of material and/or to the number of individual strips.

Figure 5:
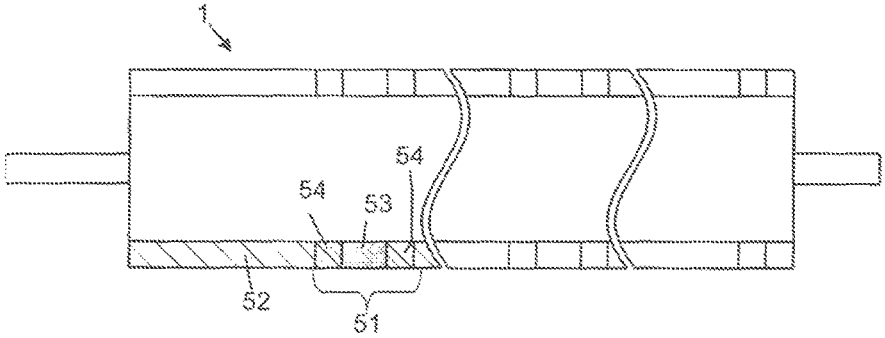
FIG. 5 illustrates a cross section through an inventive contact roll wherein the segments have a different modulus of elasticity.

FIG. 5 illustrates yet another exemplary embodiment of the inventive contact roll. Here the segments 51 are distinguished in comparison to the other regions 52 not by having different geometric configurations but by having different material characteristics, particularly having a different modulus of elasticity. The segment 51 may still be comprised of a central segment 53 and border segments 54, but here the central segment has a higher modulus of elasticity than the other regions 52. Advantageously, the border segments 54 have a modulus of elasticity which are between those of the central segment 54 and the other regions 52, thereby providing a transition of a type such as described above in connection with FIG. 4 and differences in diameter.

The embodiment according to FIG. 5 offers the major advantage that, in the region of the segments, as a result of the greater hardness of the materials, the pressure force exerted is greater than that exerted by the material in the other regions 52, so that greater force is applied to the edges of the web of material during the winding, without having to provide an outer diameter in the regions of the segments which diameter exceeds that of the other regions. Advantageously, it is possible to combine the exemplary embodiments according to FIG. 3 or FIG. 4 with the exemplary embodiment according to FIG. 5.

Figure 6:
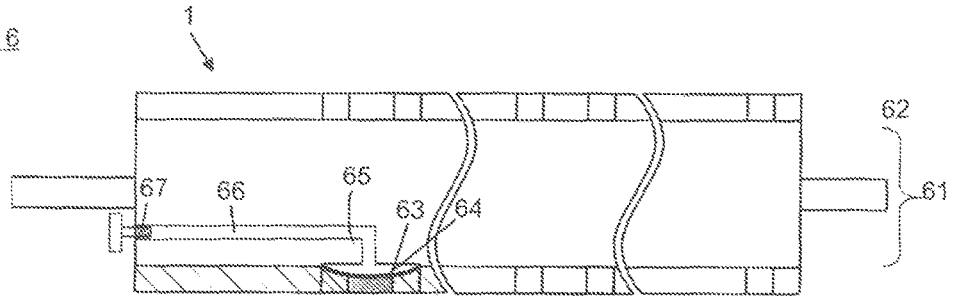
FIG. 6 illustrates a cross section through an inventive contact roll wherein the segments can be acted upon by an expansive force element.

FIG. 6 illustrates an additional, advantageous exemplary embodiment, wherein at least one expansive force element 63 is provided below the outer surface of the contact roll, advantageously at the boundary between the roll core 61 and the surface layer 62. Such an expansive force element has an outer surface 64 which has a changeable shape, which is in contact with the material of the surface layer. With this arrangement, the expansive force element may be a component of the roll core or the surface layer. Alternatively it may be in the form of a separate structural component which is pressed onto the roll core or is otherwise applied, prior to application of the surface layer. Advantageously, the expansive force element is in the form of a ring, so that it has rotational symmetry, so as to exert a uniform influence on the surface layer.

The expansive force element has a hollow space 65 which can be acted upon by a pressurized fluid. This fluid may be a gas, a liquid, or another flowable or pourable material. An incompressible liquid, such as a so-called hydraulic liquid, is particularly advantageous. In order to facilitate ready adjustability of the expansive force element, a line 66, e.g. in the form of a tube, may be provided. At the end of the line, and preferably accessible from the end side of the contact roll, a closure is provided which is displaceable relative to the line. Such displacement may serve to increase or decrease the pressure inside the expansive force element, via the fluid, resulting in a change in the radial dimension of the outer surface 64 of said expansive force element. In a practical embodiment, the closure may comprise a screw which is rotated relative to an inner thread in the line 66.

When the pressure is increased, the outer surface is moved outwardly, as described. In the process, the material of the segment is compressed and/or also moved outwardly. In the first instance, the material receives a pre-stressing, so that the contact roll 1 with these segments can exert a greater force on the edge regions of the web of material. This also occurs if, as in the second instance, the outer diameter of the segment is in fact also increased. If compressible material is used for the surface layer, advantageously the materials may have a greater, the same, or even a smaller, modulus of elasticity, than the material of the other regions.

With the contact roll according to the exemplary embodiment according to FIG. 6, obviously a plurality of the described expansive force elements may be provided. It is advantageous if these are selectively adjustable, in order to be able to adjust the contact roll to different widths of the web of material, when operating with a single strip or a plurality of individual strips.

Figure 7:
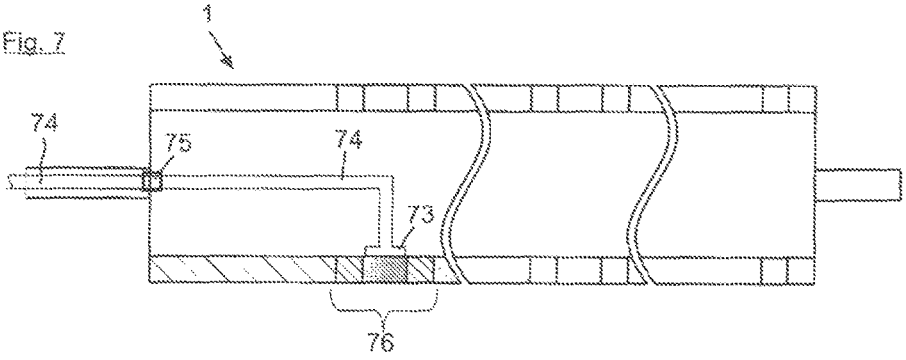
FIG. 7 illustrates a cross section through an inventive contact roll wherein the segments are gas permeable.

FIG. 7 illustrates an exemplary embodiment in which the segments 76 are gas-permeable. For this purpose, the segments 76 may be provided with thoroughgoing openings. Alternatively, or in addition, at least parts of the segments may be comprised of porous, preferably microporous material. Preferably, the material has pore sizes in the range of 10-100 microns.

A circumferential gas channel 73 may be provided interiorly of the surface layer, which channel is connected to gas lines 74. These gas lines 74 lead to the exterior, via a rotary pass-through fitting 75; there a gas supply is provided for the gas lines. Preferably, the gas supply is designed and configured such that a pressure difference of 20 mbar to 1 bar is maintained between the gas and the surroundings. Preferably, compressed air is employed as the gas.

The gas is passed through the segments to the outer surface, where a film of air develops between the segments and the edges of the web of material, so that a higher pressing force prevails in the region of the edges of the web of material, compared to the other regions.

Figure 8:
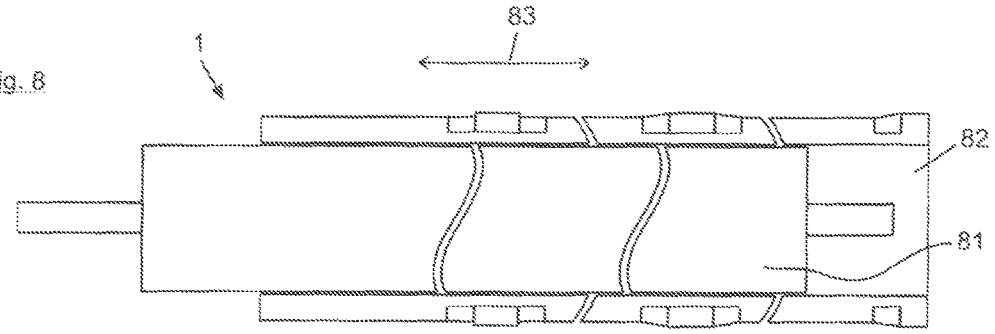
FIG. 8 illustrates a cross section through an inventive contact roll having a replaceable sleeve.

FIG. 8 illustrates an embodiment of the invention which does not depend on special configuration of the segments, but wherein the sleeve 82 which extends around the surface layer is movable along arrow 83 relative to the contact roll core. This facilitates replacement of the sleeve 82 by another which offers, e.g., a different configuration of the segments and/or a different disposition of the segments, allowing the contact roll to be adjusted to requirements relating to the components of the web of material and/or the measurements of the web of material. Additional details concerning configuration of these variants of the invention have already been provided above in the introductory section of the Specification.

Figure 9:
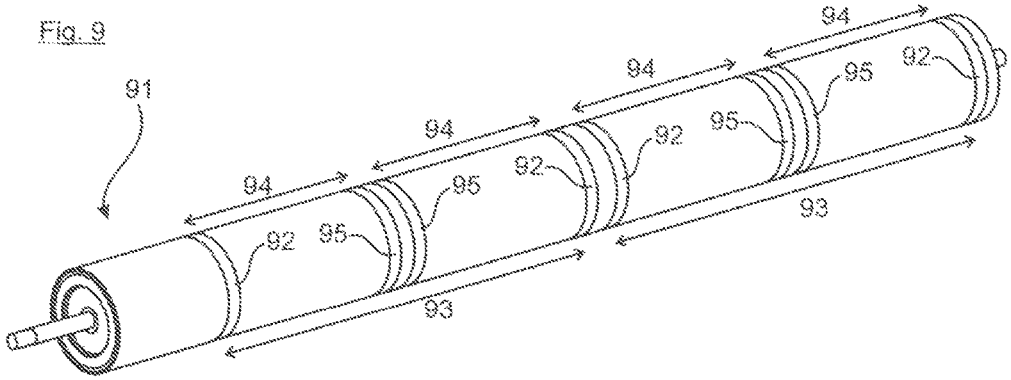
FIG. 9 illustrates an inventive contact roll which is usable with different widths of the web of material.

FIG. 9 illustrates an inventive contact roll 91 which can be employed in the event of different widths of the web of material. For this purpose, the contact roll 91 has different segments 92 disposed at different distances apart. An area of application for this exemplary embodiment. A stretch film is distinguished in that it is comprised of one of the following combinations of materials: PE-LD, PE-LLD, mPE-LLD, or PP. Here PE represents polyethylene, LD represents low density, LLD represents linear low density, mPE represents polyethylene produced with metallocene catalysts, and PP represents polypropylene. The film thicknesses are up to 50 microns, particularly up to 30 microns. The stretchability is at least 150%, particularly at least 250%. As a rule, the surfaces of these stretch films have adhesive to strongly adhesive properties. As a rule, they are wound onto winding rolls with web width of 50 cm, or 25 cm, which are standard widths employed in various automatic packaging machines. Obviously, other widths are possible, in particular larger widths such as, e.g., 45 cm, 75 cm, or 100 cm.

The segments of the contact roll are distributed such that a two-strip or one-strip winding 93 can be formed. Another option is four individual strips 94; with these configurations it may not be necessary to replace the contact roll—instead the additional segments 94 are provided which do not need to be eliminated from the contact roll when two individual strips are being formed, because they will not have an effect on the winding device. Additional segments may be provided in order to be able to process additional widths of and/or numbers of individual strips.

Figure 10:
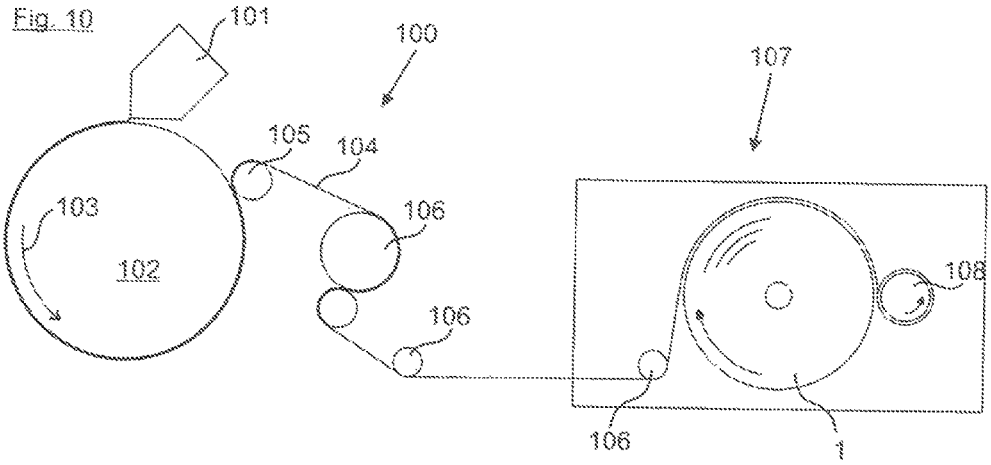
FIG. 10 illustrates a cast film extrusion apparatus with a winding device which is comprised of an inventive contact roll.

FIG. 10 illustrates schematically the essential elements of a film-casting apparatus 100, of a type which preferably may be used for fabricating the above-described stretch films. A nozzle head 101 has a plurality of plasticized plastic flows applied to it, via extruders. After these plastic flows are fed simultaneously and distributed over the width, by means of the nozzle head, the melt is delivered from the nozzle head and is passed, in the form of a melt curtain, onto the cooling roll 102, which rotates in the direction of the arrow 103. After a certain residence time, the plastic mass, which has undergone cooling there and now forms a web of film 104, is taken up from the cooling roll 102 by the roll 105. Then the web of film 104 is transported over additional rolls 106 to the winding device 107, which has an inventive contact roll 1, over which the web of film 104 is passed and by means of which the web is pressed against the winding roll 108 and is wound onto said winding roll.

In the various Figures, advantageous embodiments have been described with respect to particular individual segments. It goes without saying that in these embodiments a plurality of the segments or all of the segments may be realized in the form of a particular such segment, even though such a realization is not shown in the Figures. It should also be mentioned that particular features described in connection with individual exemplary embodiments may be freely combined with features according to other exemplary embodiments. A person skilled in the art will thus be able to arrive at advantageous combinations of features in seeking to arrange a most efficient embodiment of the invention.

LIST OF REFERENCE NUMERALS

1, 91 Contact roll.
2 Web of material.
3 Winding device
4 Pins and/or shafts
5 Machine frame.
6, 7, 26,
36, 43, 50,
76, 92 Segment.
9, 10 Edge region.
11, 12 Edge.
13 Center of the web of material.
20 Cutting knife.
21 Individual strips of material.
23 Winding device
24 Winding shaft.
31, 61 Roll core.
32, 62 Surface layer.
37, 53 Central segment.
38, 54 Edge segment.
39, 40 Outer surface.
41, 52 Other region.
42 Pervasive surface layer.
63 Expansive force element
65 Hollow space.
66 Line.
73 Gas channel.
74 Gas line.
75 Rotary pass-through fitting.
82 Sleeve.
83, 103 Arrow.
93 Winding roll bearing two individual strips.
94 Winding roll bearing four individual strips.
100 Film-casting apparatus.
101 Nozzle head.

102 Cooling roll.
104 Web of film material.
108 Winding roll.

The invention claimed is:

1. A winding device for winding at least one web of material onto a respective rotating winding roll, comprised of a contact roll for pressing at least one web of material onto at least one rotating winding roll, said contact roll having a surface layer;

wherein at least two segments are provided which are separated from each other in the axial direction and which extend around in the circumferential direction, in which at least two segments having the characteristics of the surface layer differ from the characteristics in the other regions of the surface layer, wherein at least some portions of said segments are in contact with the edges of the at least one web of material;

the segments of the surface layer have a greater material hardness than the other regions of the surface layer; and in the region of the segments, the restoration force of the material is greater that in the other regions, resulting in greater pressure force being applied to the edge of the web material.

2. The winding device according to claim 1;

wherein the web of material is a web of plastic film material.

3. The winding device according to claim 1;

wherein the segments have a greater outer surface diameter than the respective regions of the surface layer which neighbor the segments.

4. The winding device according to claim 1;

wherein the surface layer has various roughnesses on its outer surface, the roughness of the segments having a different value than the roughness of the other regions.

5. The winding device according to claim 4;

wherein the roughness of the segments is less than the roughness of the other regions.

6. The winding device according to claim 1;

wherein the surface layer has a bulging shape.

7. The winding device according to claim 1;

wherein the contact roll has a base body and at least one sleeve concentrically surrounding the base body, which sleeve has one or more layers, the outer of which layers comprises the surface layer.

8. The winding device according to claim 7;

wherein the base body is comprised at least partly of carbon-reinforced and/or glass fiber reinforced plastic.

9. The winding device according to claim 7;

wherein the sleeve which concentrically surrounds the base body is displaceable relative to the base body.

10. The winding device according to claim 7;

wherein the sleeve which concentrically surrounds the base body is connectable to the base body by force-interlocking.

11. A method of winding at least one web of material wherein at least one web of material is pressed against at least two rotating winding rolls by means of a contact roll having a surface layer;

wherein at least two segments which are separated from each other in the axial direction and which extend around in the circumferential direction, in which at least two segments having the characteristics of the surface layer differ from the characteristics in the other regions of the surface layer, are in contact with or are brought into contact with the edges of the at least one web of material;

the segments of the surface layer have a greater material hardness than the other regions of the surface layer; and in the region of the segments, the restoration force of the material is greater that in the other regions, resulting in greater pressure force being applied to the edge of the web material.

12. The method according to claim 11;

wherein the web of material is a web of plastic film material.

* * * * *